US007952539B2

(12) United States Patent
Choi et al.

(10) Patent No.: US 7,952,539 B2
(45) Date of Patent: May 31, 2011

(54) APPARATUS FOR SUPPLYING DRIVING SIGNALS TO PLASMA DISPLAY PANEL AND PLASMA DISPLAY PANEL THEREOF

(75) Inventors: Jeong Pil Choi, Seoul (KR); Seong Ho Kang, Seoul (KR)

(73) Assignee: LG Electronics Inc., Seoul (KR)

( * ) Notice: Subject to any disclaimer, the term of this patent is extended or adjusted under 35 U.S.C. 154(b) by 790 days.

(21) Appl. No.: 11/931,319

(22) Filed: Oct. 31, 2007

(65) Prior Publication Data

US 2009/0109136 A1 Apr. 30, 2009

(30) Foreign Application Priority Data

Oct. 26, 2007 (KR) ..... 10-2007-0108322

(51) Int. Cl.
*G09G 3/28* (2006.01)

(52) U.S. Cl. ..... 345/63

(58) Field of Classification Search ..... 345/63
See application file for complete search history.

(56) References Cited

U.S. PATENT DOCUMENTS

| | | | | |
|---|---|---|---|---|
| 2004/0080280 | A1* | 4/2004 | Hibino et al. | 315/169.4 |
| 2005/0162344 | A1* | 7/2005 | Kang et al. | 345/60 |
| 2006/0145955 | A1* | 7/2006 | Choi | 345/67 |
| 2006/0158389 | A1* | 7/2006 | Moon | 345/67 |
| 2006/0214885 | A1* | 9/2006 | Jung et al. | 345/63 |
| 2007/0205967 | A1* | 9/2007 | Kim et al. | 345/67 |

FOREIGN PATENT DOCUMENTS

| | | |
|---|---|---|
| KR | 10-2005-0045636 | 5/2005 |
| KR | 10-2005-0111140 | 11/2005 |
| KR | 10-2006-0083804 | 7/2006 |

OTHER PUBLICATIONS

Korean Office Action dated Mar. 10 2009.

* cited by examiner

*Primary Examiner* — Chanh Nguyen
*Assistant Examiner* — Long Pham
(74) *Attorney, Agent, or Firm* — Ked & Associates LLP

(57) ABSTRACT

The present invention relates to a driving apparatus for supplying a driving signal to a plasma display panel, and a plasma display apparatus employing the same. A reset signal supplied during a reset period of a first subfield of a plurality of subfields includes a first rising period where a voltage rises up to a first voltage, and a first sustain period where the first voltage is sustained. A reset signal supplied during a reset period of a second subfield includes a second rising period where a voltage rises up to a second voltage lower than the first voltage, and a second sustain period where the second voltage is sustained. The second voltage is higher than a sustain voltage. In accordance with the present invention, if it is sought to reset discharge cells of a PDP in a reset period, a signal whose voltage gradually rises up to a voltage higher than the sustain voltage is applied to a scan electrode. Accordingly, wall charges of the scan electrode for addressing can be controlled effectively, the highest voltage of the reset signal can be lowered and, therefore, driving margin can be secured. Further, since the sustain period of the highest voltage is included, stabilized discharge can be generated irrespective of variation of an APL of a display screen.

17 Claims, 8 Drawing Sheets

APPARATUS FOR SUPPLYING DRIVING SIGNALS TO PLASMA DISPLAY PANEL AND PLASMA DISPLAY PANEL THEREOF

This Nonprovisional application claims priority under 35 U.S.C. §119(a) on Patent Application No. 10-2007-0108322 filed in Korea on Oct. 26, 2007, the entire contents of which are hereby incorporated by reference.

BACKGROUND OF THE INVENTION

1. Field of the Invention

The present invention relates to a plasma display apparatus, and more particularly, to a driving apparatus for supplying driving signals to a plasma display panel (PDP).

2. Discussion of Related Art

A PDP is adapted to display images by exciting phosphors with Vacuum UltraViolet rays (VUV) generated when an inert mixed gas is discharged.

The PDP has advantages that it can be easily made large and thin and can be simply fabricated due to a simple structure, and has higher luminance and emission efficiency than other flat display devices. In particular, an alternating current (AC) surface discharge type three-electrode PDP is advantageous in that it has lower voltage driving and longer lifespan because wall charges are accumulated on a surface upon discharge and protect electrodes from sputtering generated by a discharge.

The PDP is driven with it being time-divided into a reset period for resetting the entire cells, an address period for selecting a cell, and a sustain period for generating a display discharge in a selected cell in order to implement gray levels of an image.

In order for a driving circuit to supply driving signals to a PDP, a plurality of switching elements and clamping diodes are required. Thus, there are problems in a rising cost due to an increased number of components and an increased size. There is also a problem in that consumption power of a panel driving circuit increases due to the increased components.

If the entire electrodes are not reset to a wall charge state for addressing during the reset period, erroneous discharge may occur or discharge may not be generated in the address period. Consequently, a problem arose in that the picture quality of display images is degraded.

SUMMARY OF THE INVENTION

Accordingly, an embodiment of the present invention is directed toward a driving apparatus capable of effectively resetting discharge cells anterior to addressing in order to solve the above problems in a panel driving apparatus included in a plasma display apparatus, and a plasma display apparatus employing the same.

In accordance with an embodiment of the present invention, there is provided a plasma display apparatus, including a PDP having a plurality of scan electrodes and sustain electrodes formed on a front substrate and a plurality of address electrodes formed on a rear substrate, and a driver for supplying driving signals to the plurality of electrodes. The PDP is driven with a unit frame being divided into a plurality of subfields. A reset signal supplied during a reset period of a first subfield of the plurality of subfields comprises a first rising period where a voltage rises up to a first voltage, and a first sustain period where the first voltage is sustained. A reset signal supplied during a reset period of a second subfield comprises a second rising period where a voltage rises up to a second voltage lower than the first voltage, and a second sustain period where the second voltage is sustained. The second voltage is higher than a sustain voltage.

In accordance with another embodiment of the present invention, there is provided a driving apparatus of a PDP for supplying a driving signal to the PDP having a plurality of scan electrodes and sustain electrodes formed on a front substrate and a plurality of address electrodes formed on a rear substrate. The PDP is driven with a unit frame being divided into a plurality of subfields. A reset signal supplied during a reset period of a first subfield of the plurality of subfields comprises a first rising period where a voltage rises up to a first voltage, and a first sustain period where the first voltage is sustained. A reset signal supplied during a reset period of a second subfield comprises a second rising period where a voltage rises up to a second voltage lower than the first voltage, and a second sustain period where the second voltage is sustained. The second voltage is higher than a sustain voltage.

DETAILED DESCRIPTION OF THE INVENTION

Figure 1:
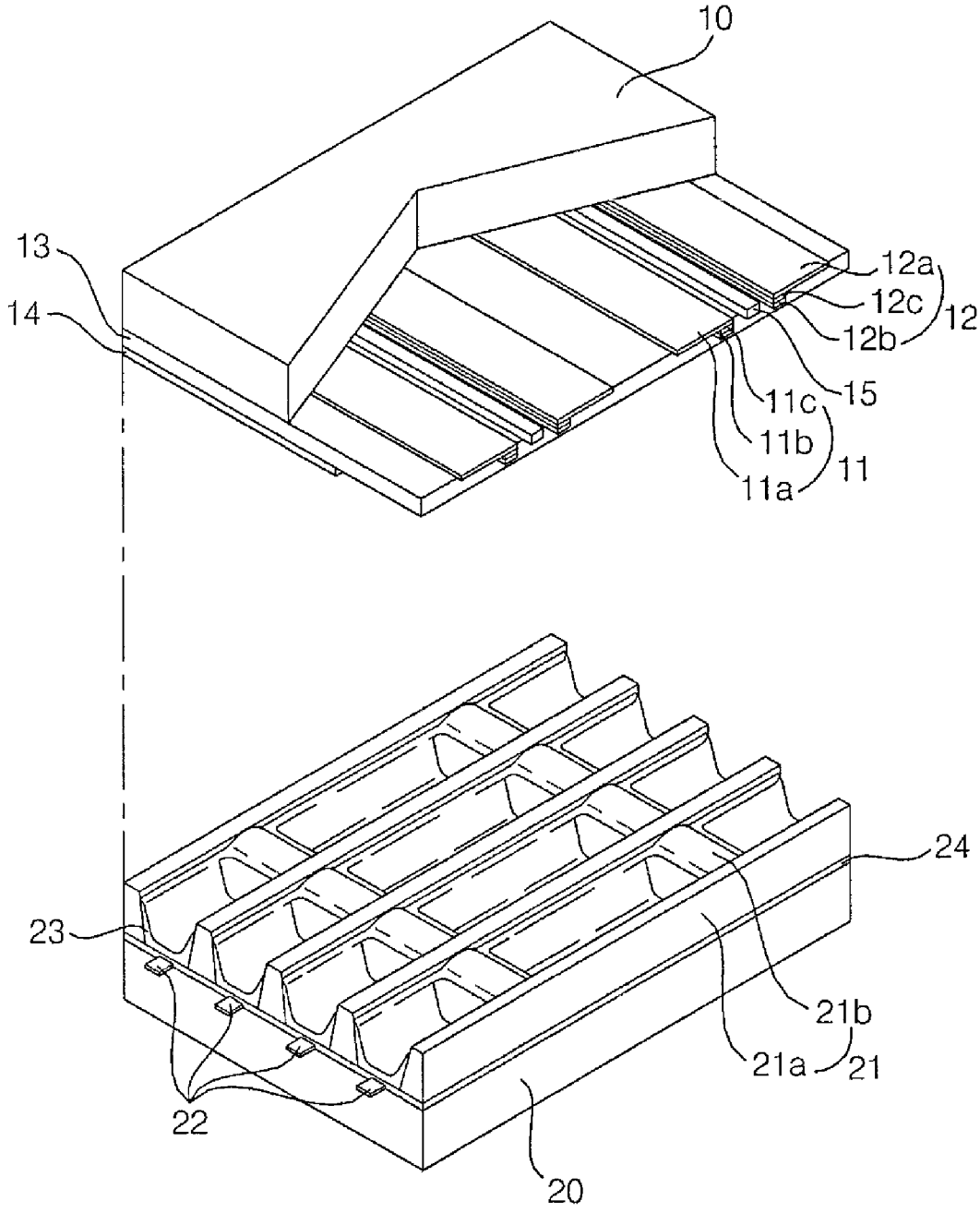
FIG. 1 is a perspective view illustrating an embodiment of a structure of a PDP.

Hereinafter, a panel driving apparatus and a plasma display apparatus employing the same in accordance with the present invention will be described in detail in connection with specific embodiments with reference to the accompanying drawings. FIG. 1 is a perspective view illustrating an embodiment of a structure of a PDP.

Referring to FIG. 1, the PDP includes a scan electrode 11 and a sustain electrode 12 (that is, a sustain electrode pair), which are formed over a front substrate 10, and address electrodes 22 formed over a rear substrate 20.

The sustain electrode pair 11 and 12 includes transparent electrodes 11*a* and 12*a* generally formed from indium-tin-oxide (ITO), and bus electrodes 11*b* and 12*b*. The bus electrodes 11*b* and 12*b* may be formed from metal, such as silver (Ag) or chrome (Cr), a stack type of Cr/copper (Cu)/Cr or Cr/aluminum (Al)/Cr. The bus electrodes 11*b* and 12*b* are formed on the transparent electrodes 11*a* and 12*a*, and function to decrease a voltage drop caused by the transparent electrodes 11*a* and 12*a* with a high resistance.

In accordance with an embodiment of the present invention, the sustain electrode pair 11 and 12 may have a stack structure of the transparent electrodes 11*a* and 12*a* and the bus electrodes 11*b* and 12*b*, but also include only the bus electrodes 11*b* and 12*b* without the transparent electrodes 11*a* and 12*a*. This structure is advantageous in that it can save the manufacturing cost of the PDP because the transparent electrodes 11*a* and 12*a* are not used. The bus electrodes 11*b* and 12*b* used in the structure may also be formed using a variety of materials, such as a photosensitive material, other than the above-listed materials.

Black matrices 15 are arranged between the transparent electrodes 11*a* and 12*a* and the bus electrodes 11*b* and 12*b* of the scan electrode 11 and the sustain electrode 12. The black matrix 15 has a light-shielding function of absorbing external light generated outside the front substrate 10 and decreasing reflection of the light and a function of improving the purity and contrast of the front substrate 10.

The black matrices 15 in accordance with an embodiment of the present invention are formed over the front substrate 10. Each black matrix 15 may include a first black matrix 15 formed at a location where it is overlapped with a barrier rib 21, and second black matrices 11*c* and 12*c* formed between the transparent electrodes 11*a* and 12*a* and the bus electrodes 11*b* and 12*b*. The first black matrix 15, and the second black matrices 11*c* and 12*c*, which are also referred to as black layers or black electrode layers, may be formed at the same time and, therefore, may be connected physically. Alternatively, they may not be formed at the same time and, therefore, may not be connected physically.

In the event that the first black matrix 15 and the second black matrices 11*c* and 12*c* are connected to each other physically, the first black matrix 15 and the second black matrices 11*c* and 12*c* are formed using the same material. However, in the event that the first black matrix 15 and the second black matrices 11*c* and 12*c* are physically separated from each other, they may be formed using different materials.

An upper dielectric layer 13 and a protection layer 14 are laminated over the front substrate 10 in which the scan electrodes 11 and the sustain electrodes 12 are formed in parallel. Charged particles generated by a discharge are accumulated on the upper dielectric layer 13. The upper dielectric layer 13 and the protection layer 14 may function to protect the sustain electrode pair 11 and 12. The protection layer 14 functions to protect the upper dielectric layer 13 from sputtering of charged particles generated at the time of a gas discharge and also increase emission efficiency of secondary electrons.

The address electrodes 22 cross the scan electrodes 11 and the sustain electrodes 12. A lower dielectric layer 24 and the barrier ribs 21 are formed over the rear substrate 20 over which the address electrodes 22 are formed.

Phosphor layers 23 are formed on the surfaces of the lower dielectric layer 24 and the barrier ribs 21. Each barrier rib 21 has a longitudinal barrier rib 21*a* and a traverse barrier rib 21*b* formed in a closed type. The barrier rib 21 functions to partition discharge cells physically and prevent ultraviolet rays, which are generated by a discharge, and a visible ray from leaking to neighboring discharge cells.

The embodiment of the present invention may also be applied to not only the structure of the barrier ribs 21 shown in FIG. 1, but also various forms of structures of the barrier ribs 21. For example, the present embodiment may be applied to a differential type barrier rib structure in which the longitudinal barrier rib 21*a* and the traverse barrier rib 21*b* have different heights, a channel type barrier rib structure in which a channel, which can be used as an exhaust passage, is formed in at least one of the longitudinal barrier rib 21*a* and the traverse barrier rib 21*b*, a hollow type barrier rib structure in which a hollow is formed in at least one of the longitudinal barrier rib 21*a* and the traverse barrier rib 21*b*, and so on.

In the differential type barrier rib structure, the traverse barrier rib 21*b* may preferably have a higher height than the longitudinal barrier rib 21*a*. In the channel type barrier rib structure or the hollow type barrier rib structure, a channel or hollow may be preferably formed in the traverse barrier rib 21*b*.

Meanwhile, in the present embodiment, it has been described and shown that the red (R), green (G), and blue (B) discharge cells are arranged on the same line. However, they may be arranged in different forms. For example, the R, G, and B discharge cells may also have a delta type arrangement of a triangle. Alternatively, the discharge cells may be arranged in various forms, such as square, pentagon and hexagon.

Furthermore, the phosphor layer 23 is excited with ultraviolet rays generated during the discharge of a gas, thus generating a visible ray of one of R, G, and B. Discharge spaces between the front/rear substrates 10 and 20 and the barrier ribs 21 are injected with an inert mixed gas for a discharge, such as He+Xe, Ne+Xe or He+Ne+Xe.

Figure 2:
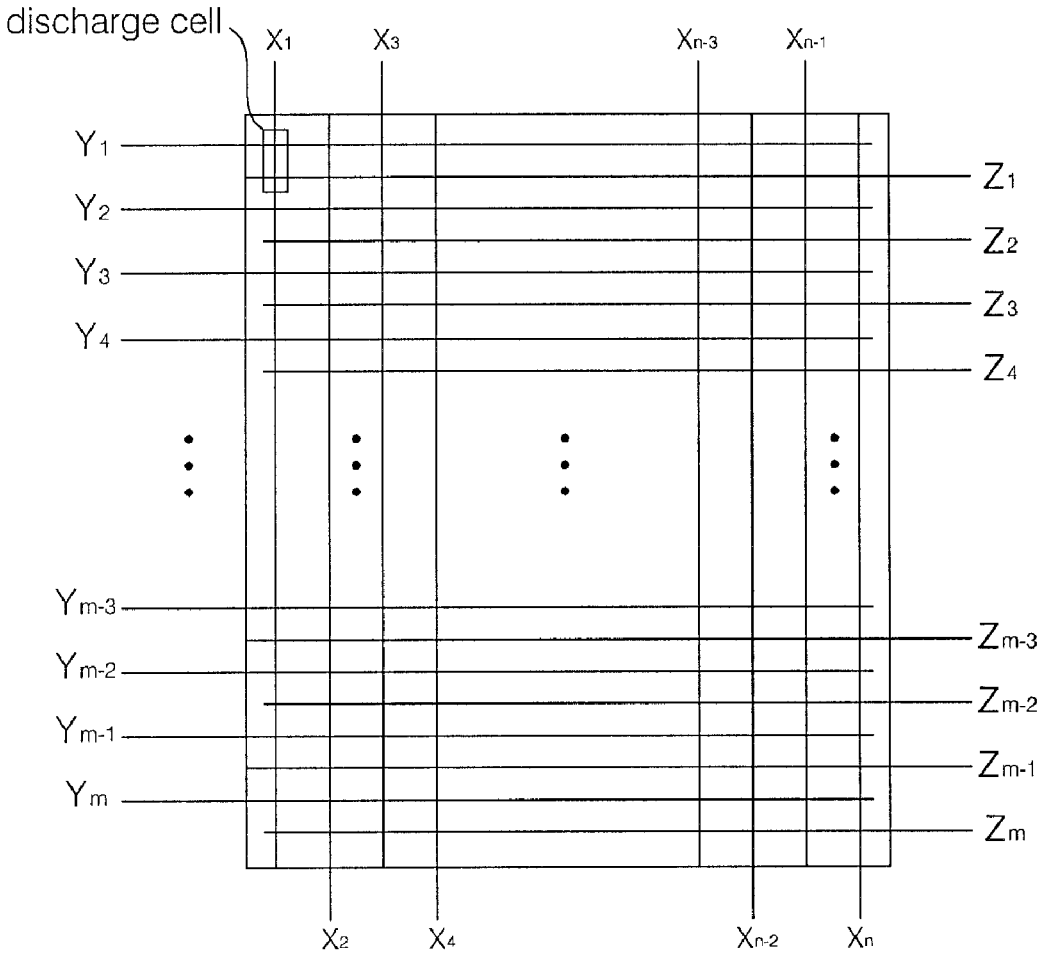
FIG. 2 is a sectional view illustrating an embodiment of the arrangements of electrodes of the PDP.

FIG. 2 is a view illustrating an embodiment of electrode arrangements of the PDP. It is preferred that a plurality of discharge cells constituting the PDP be arranged in a matrix form as illustrated in FIG. 2. The plurality of discharge cells are disposed at the intersections of scan electrode lines Y1 to Ym, sustain electrodes lines Z1 to Zm, and address electrodes lines X1 to Xn, respectively. The scan electrode lines Y1 to Ym may be driven sequentially or at the same time. The sustain electrode lines Z1 to Zm may be driven at the same time. The address electrode lines X1 to Xn may be driven with them being divided into even-numbered lines and odd-numbered lines, or driven sequentially.

The electrode arrangements shown in FIG. 2 are only an embodiment of electrode arrangements of the PDP according to the present invention. Therefore, the present invention is not limited to the electrode arrangements and the driving method of the PDP shown in FIG. 2. For example, the present invention may also be applied to a dual scan method of driving two of the scan electrode lines Y1 to Ym at the same time. Alternatively, the address electrode lines X1 to Xn may be driven with them being divided into upper and lower parts on the basis of the center of the PDP.

Figure 3:
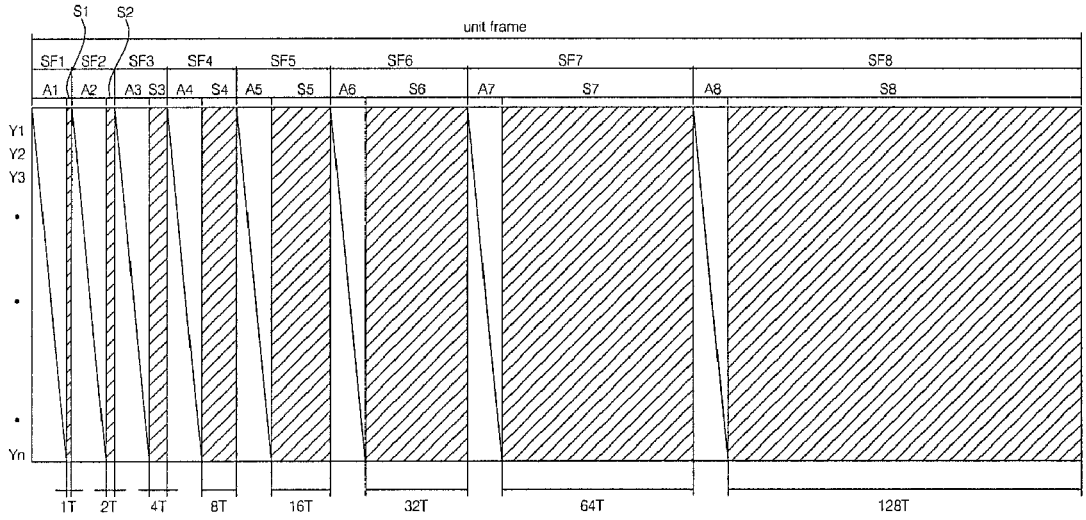
FIG. 3 is a timing diagram illustrating an embodiment of a method of time-dividing and driving the PDP by dividing one frame into a plurality of subfields.

FIG. 3 is a timing diagram illustrating an embodiment of a method of time-dividing and driving the PDP by dividing one frame into a plurality of subfields. A unit frame may be divided into a predetermined number (for example, eight subfields SF1, . . . , SF8) in order to realize a time-divided gray level display. Each of the subfields SF1, . . . , SF8 is divided into a reset period (not shown), address periods A1, . . . , A8, and sustain periods S1, . . . , S8.

In accordance with an embodiment of the present invention, the reset period may be omitted in at least one of the plurality of subfields. For example, the reset period may exist only in the first subfield, or exist only in a subfield approximately between the first subfield and the entire subfields.

In each of the address periods A1, . . . , A8, a display data signal is applied to the address electrode X, and scan signals corresponding to the scan electrodes Y are sequentially applied to the address electrode X.

In each of the sustain periods S1, . . . , S8, a sustain pulse is alternately applied to the scan electrodes Y and the sustain electrodes Z. Accordingly, a sustain discharge is generated in discharge cells on which wall charges are formed in the address periods A1, . . . , A8.

The luminance of the PDP is proportional to the number of sustain discharge pulses within the sustain periods S1, . . . , S8, which is occupied in a unit frame. In the event that one frame to form 1 image is represented by eight subfields and 256 gray levels, different numbers of sustain pulses may be sequentially allocated to the respective subfields at a ratio of 1, 2, 4, 8, 16, 32, 64, and 128. For example, in order to obtain the luminance of 133 gray levels, a sustain discharge can be generated by addressing the cells during the subfield1 period, the subfield3 period, and the subfield8 period.

The number of sustain discharges allocated to each subfield may be varied depending on the weight of a subfield according to an Automatic Power Control (APC) step. In other words, although an example in which one frame is divided into eight subfields has been described with reference to FIG. 3, the present invention is not limited to the above example, but the number of subfields to form one frame may be changed in various ways depending on design specifications. For example, the PDP may be driven by dividing one frame into eight or more subfields, such as 12 or 16 subfields.

Further, the number of sustain discharges allocated to each subfield may be changed in various ways in consideration of gamma characteristics or panel characteristics. For example, the degree of gray levels allocated to the subfield4 may be lowered from 8 to 6, and the degree of gray levels allocated to the subfield6 may be raised from 32 to 34.

Figure 4:
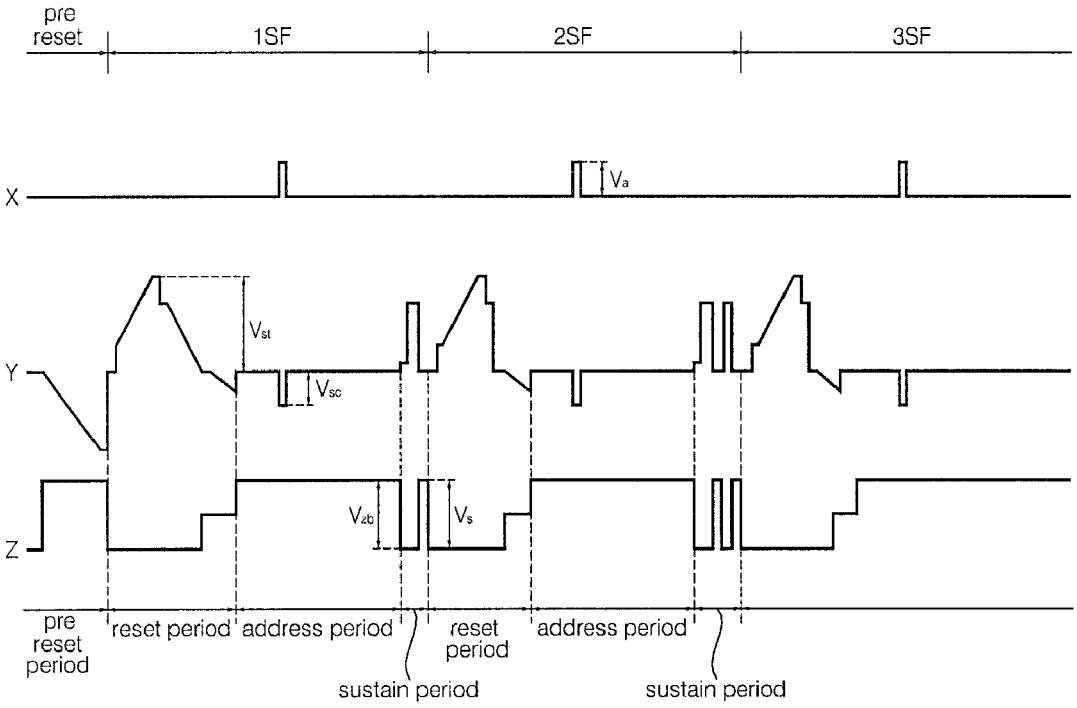
FIG. 4 is a timing diagram illustrating an embodiment of driving signals for driving the PDP.

FIG. 4 is a timing diagram illustrating an embodiment of driving signals for driving the PDP with respect to the one divided subfield.

Each subfield includes a pre-reset period where positive wall charges are formed on the scan electrodes Y and negative wall charges are formed on the sustain electrodes Z, a reset period where discharge cells of the entire screen are reset using wall charge distributions formed in the pre-reset period, an address period where discharge cells are selected, and a sustain period where the discharge of selected discharge cells is sustained.

The reset period includes a set-up period and a set-down period. In the set-up period, a ramp-up waveform is applied to the entire scan electrodes at the same time, so that a minute discharge occurs in the entire discharge cells and wall charges are generated accordingly. In the set-down period, a ramp-down waveform, which falls from a positive voltage lower than a peak voltage of the ramp-up waveform, is applied to the entire scan electrodes Y at the same time, so that an erase discharge occurs in the entire discharge cells. Accordingly, unnecessary charges are erased from the wall charges generated by the set-up discharge and spatial charges.

In the address period, a scan signal scan having a negative voltage Vsc is sequentially applied to the scan electrodes, and a data signal data having a positive voltage Va is applied to the address electrodes simultaneously with the scan signal. Thus, an address discharge is generated by a voltage difference between the scan signal scan and the data signal data and a wall voltage generated during the reset period, so that the cells are selected. On the other hand, during the set-down period and the address period, a signal to sustain a sustain voltage is applied to the sustain electrode.

In the sustain period, a sustain pulse having a sustain voltage Vs is alternately applied to the scan electrode and the sustain electrode, so that a sustain discharge is generated between the scan electrode and the sustain electrode in the form of a surface discharge.

The driving waveforms shown in FIG. 4 correspond to an embodiment of signals for driving the PDP according to the present invention, and the present invention is not limited to the waveforms shown in FIG. 4. For example, the pre-reset period may be omitted, the polarity and voltage levels of the driving signals shown in FIG. 4 may be changed, if appropriate, and an erase signal for erasing wall charges may be applied to the sustain electrode after the sustain discharge is completed. Alternatively, the present invention may also be applied to a single sustain driving method of generating a sustain discharge by applying the sustain signal to either the scan electrode Y or the sustain electrode Z.

Figure 5:
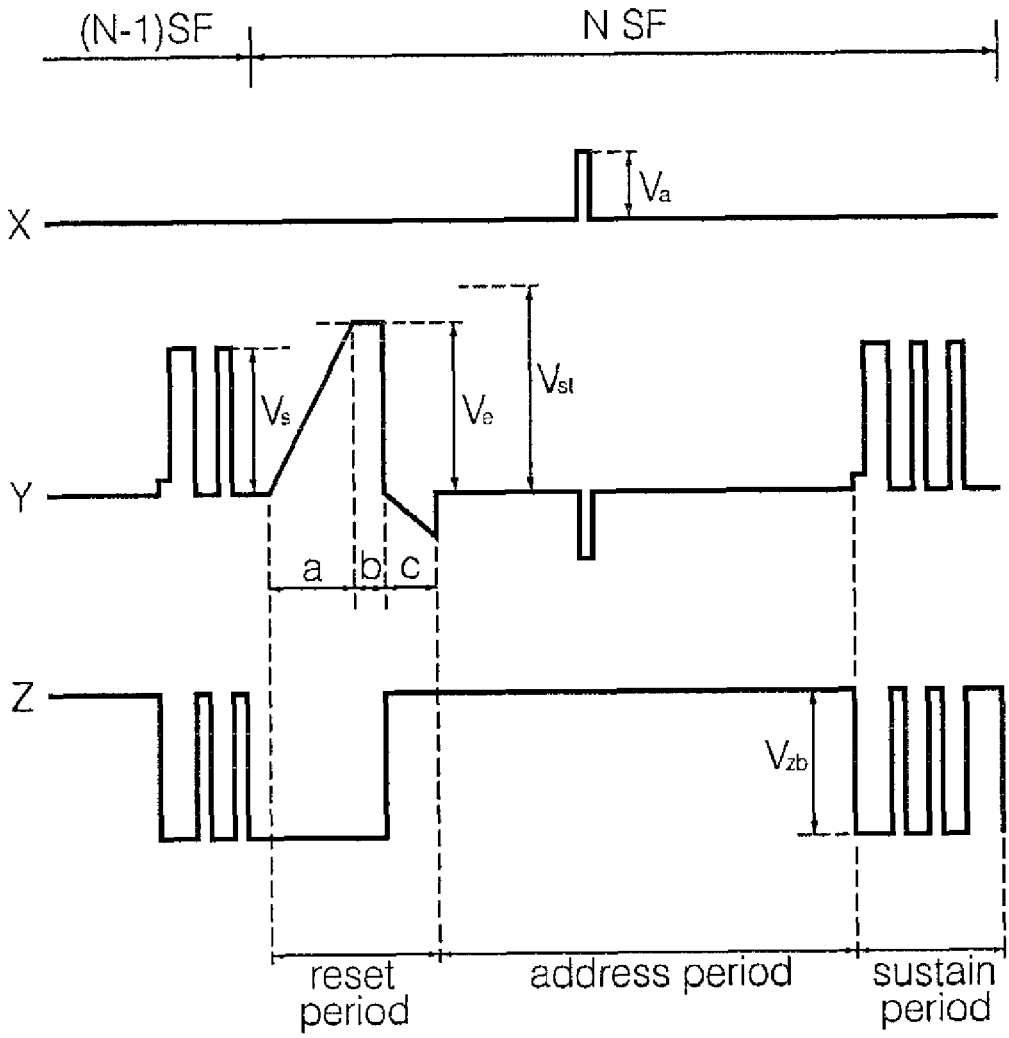
FIG. 5 is a timing diagram illustrating a first embodiment of waveforms of panel driving signals in accordance with the present invention.

FIG. 5 is a timing diagram illustrating a first embodiment of waveforms of panel driving signals in accordance with the present invention.

Referring to FIG. 5, any one subfield of a plurality of subfields constituting one frame, for example, the highest voltage Ve of a reset signal supplied in an $N^{th}$, subfield may be lower than the highest voltage Vst of a reset signal supplied in other subfield.

In other words, a reset signal whose voltage rises up to Vst may be supplied to the scan electrode Y in some of the plurality of subfields, as shown in FIG. 4, and a reset signal whose voltage rises up to Ve, which is lower than Vst, may be supplied to the scan electrode Y in the remaining subfields, as in the $N^{th}$, subfield shown in FIG. 5.

If the highest voltage of the reset signal supplied in some subfields is lowered as described above, PDP driving margin can be secured, which can be advantageous for high speed driving, and power consumed in panel driving can also be saved.

In this case, in the sustain period of a previous subfield (that is, a $(N-1)^{th}$ subfield) of the $N^{th}$ subfield, the last sustain signal of a plurality of sustain signals may be supplied to the sustain electrode Z as shown in FIG. 4.

If the last sustain signal is supplied to the sustain electrode Z in the $(N-1)^{th}$ subfield as described above, wall charges of a positive polarity (+) are formed on the scan electrode Y where sustain discharge has occurred and wall charges of a negative polarity (+) are formed on the sustain electrode Z.

Accordingly, even though the reset signal whose voltage rises up to Ve lower than Vst is supplied to the scan electrode Y in the $N^{th}$ subfield, reset discharge can be generated sufficiently in the scan electrode Y where sustain discharge has occurred in the $(N-1)^{th}$ subfield.

In order to form a large amount of wall charges of the positive polarity (+) on the scan electrode Y by sufficiently generating such reset discharge and thus reduce addressing error, the highest voltage Ve of the reset signal supplied in the $N^{th}$ subfield may be preferably higher than the sustain voltage Vs.

In other words, the apparatus for driving the PDP according to the present invention may preferably supply a reset signal having the highest voltage Ve, which is lower than a voltage in other subfields, in at least one of the plurality of subfields, and the highest voltage Ve of the reset signal may be preferably higher than the sustain voltage Vs.

Further, as shown in FIG. 5, the reset signal supplied in the $N^{th}$ subfield may include a sustain period (b), which is sustained to the voltage Ve after a rising period (a) where the voltage Vs rises up to the voltage Ve.

Capacitance of the PDP may vary depending on the APL of a display screen and, therefore, the slope of the set-up period or the set-down period of the reset signal may vary.

In other words, if the APL of the display screen is increased, capacitance of the PDP is increased and therefore the set-up period slope of the reset signal may be decreased. In contrast, if the APL of the display screen is decreased, capacitance of the PDP is decreased and therefore the set-up period slope of the reset signal may be increased.

As described above, if the APL of the display screen is increased, the set-up period slope of the reset signal can be reduced. Thus, in the event that the length of the set-up period is fixed, the highest voltage of the reset signal can be lowered and the amount of wall charges of the positive polarity (+), which are formed on the scan electrode Y, can be decreased, thereby generating addressing error.

If the sustain period (b) where the voltage Ve is sustained is included in the reset signal whose voltage rises up to the voltage Ve, which is higher than the sustain voltage Vs, but lower than the highest voltage Vst of the reset signal of other subfields as shown in FIG. 5, the highest voltage Ve of the reset signal can be prevented from varying depending on variation of the APL of the display screen. Therefore, wall charges of the positive polarity (+) can be formed on the scan electrode Y sufficiently, and addressing error can be reduced.

Figure 6:
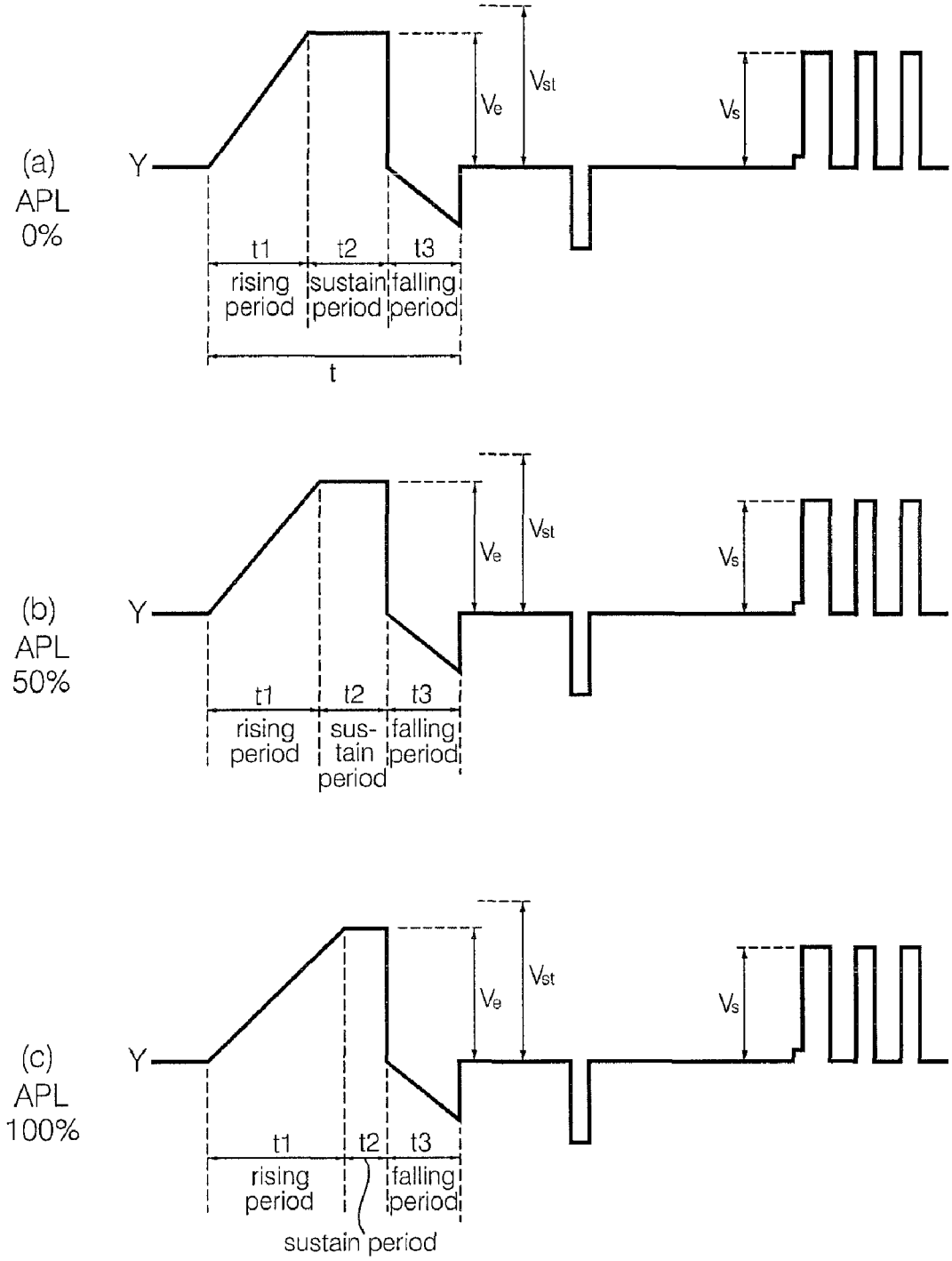
FIG. 6 is a timing diagram illustrating embodiments of waveforms of reset signals according to variation of an Average Picture Level (APL) of a display screen.

FIG. 6 is a timing diagram illustrating embodiments of waveforms of reset signals according to variation of an APL of a display screen.

Referring to FIG. 6, a reset signal supplied in at least one of a plurality of subfields may include a rising period where the voltage Ve gradually rises, a sustain period where the voltage Ve is sustained, and a falling period where the voltage Ve gradually falls.

As shown in FIG. 6, the reset signal in accordance with the present invention includes the sustain period where Ve (that is, the highest voltage) is sustained, so that a voltage can rise up to Ve (that is, a preset highest voltage) irrespective of an APL of a display screen.

As mentioned earlier, the rising period slope of the reset signal may be changed depending on the APL of the display screen. Due to this, time taken to rise up to the highest voltage Ve (that is, the length t1 of the rising period) may be changed.

In more detail, when the APL of the display screen shown in FIG. 6(*a*) is 0% (that is, when the display screen is full black), the rising period slope of the reset signal is the greatest. Accordingly, the rising period length t1 of the reset signal may be the shortest.

When the APL of the display screen shown in FIG. 6(*b*) is 50%, the rising period slope of the reset signal is smaller than those shown in FIG. 6(*a*). Accordingly, the rising period length t1 of the reset signal may be longer than those shown in FIG. 6(*a*).

When the APL of the display screen shown in FIG. 6(*c*) is 100% (that is, when the display screen is full white), the rising period slope of the reset signal is the smallest. Accordingly, the rising period length t1 of the reset signal may be the longest.

In order to stably drive the PDP by securing driving margin of the PDP, assuming that a total length t of the reset signal and a length (t1+t2) of the rising period and the sustain period are fixed, the sustain period length t2 of the reset signal may be decreased in order of FIG. 6(*a*), FIG. 6(*b*), and FIG. 6(*c*).

In other words, as the APL of the display screen is increased, the rising period length t1 of the reset signal may be increased and, therefore, the length t2 of the sustain period may be shortened.

For the above reason, as the APL of the display screen is increased, a falling period slope of the reset signal may be increased (an absolution value of the slope is reduced). In other words, the slope of the reset signal falling period may be the smallest when the APL of the display screen shown in FIG. 6(*a*) is 0%, and the slope of the reset signal falling period may be the greatest when the APL of the display screen shown in FIG. 6(*c*) is 100%.

As described above, the driving apparatus of the PDP according to the present invention can stabilize panel driving because the sustain period of a sufficient length where the reset signal can rise up to a predetermined voltage Ve is included in the reset signal although the APL of the display screen has a predetermined value ranging from 0% to 100.

Figure 7:
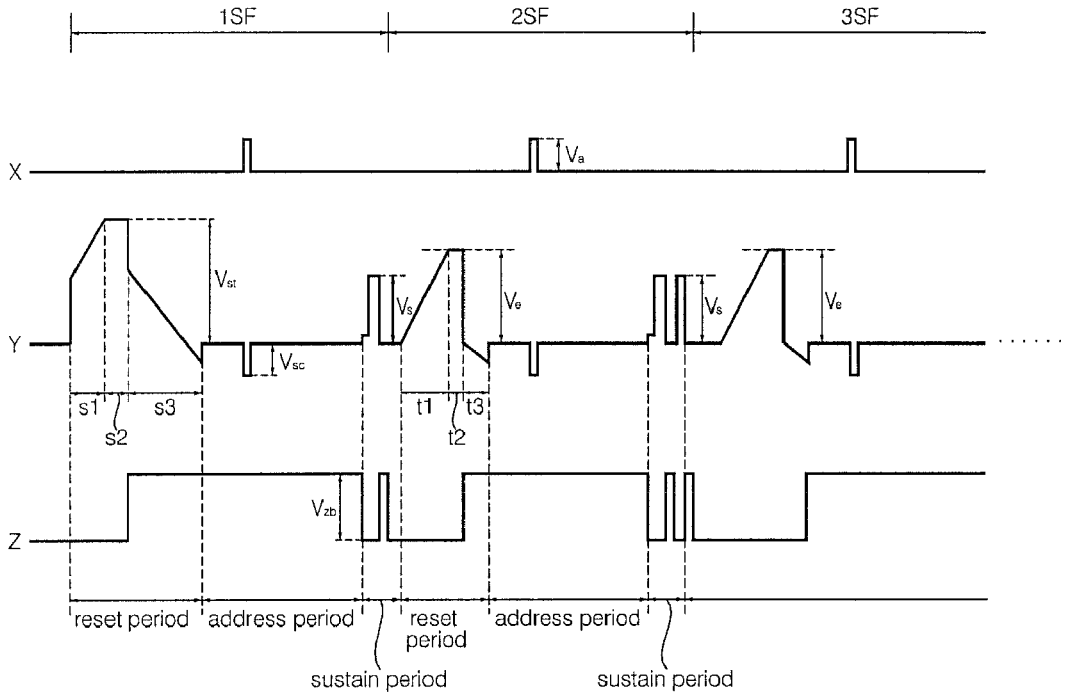
FIG. 7 is a timing diagram illustrating a second embodiment of waveforms of panel driving signals in accordance with the present invention.

FIG. 7 is a timing diagram illustrating a second embodiment of waveforms of panel driving signals in accordance with the present invention.

Referring to FIG. 7, a reset signal whose voltage rises up to Vst may be supplied to the scan electrode Y in a first subfield of a plurality of subfields constituting one frame, and a reset signal whose voltage rises up to a voltage Ve, which is lower than the voltage Vst, but higher than a sustain voltage Vs, may be supplied to the scan electrode Y in the remaining subfields subsequent to the first subfield. Further, as shown in FIG. 7, the reset signals supplied in the plurality of subfields may include the sustain period where the highest voltage (that is, Vst or Ve) is sustained.

The plurality of subfields constituting the one frame may be arranged in order from a lower weight (that is, where the number of sustain signals supplied in each subfield is small) to a higher weight (that is, where the number of sustain signals supplied in each subfield is great). Thus, the first subfield may be a subfield having the least number of sustain signals, of the plurality of subfields.

In the first subfield of the plurality of subfields constituting one frame, a reset signal whose voltage rises up to Vst (that is, a high voltage in order to generate reset discharge in the entire discharge cells) may be supplied, and in the remaining subfields, a reset signal whose voltage rises up to Ve lower than the voltage Vst may be supplied, so reset discharge may be generated only in discharge cells where sustain discharge has occurred in a previous subfield.

In order to enable high-speed driving by securing driving margin for the PDP, a rising period length t1 of the reset signal whose voltage rises up to Ve may be shorter than a rising period length s1 of the reset signal whose voltage rises up to Vst, a rising period slope of the reset signal whose voltage rises up to Ve may be greater than a rising period slope of the reset signal whose voltage rises up to Vst, and a falling period length t3 of the reset signal where the voltage Ve drops may be shorter than a falling period length s3 of the reset signal where the voltage Vst drops, as shown in FIG. 7.

Thus, when considering time taken to drive one frame and a ratio where the reset period is occupied in the frame, the rising period length t1 of the reset signal whose voltage rises up to Ve may be in the range of 1 μs to 100 μs. The APL of the display screen may be changed within the range.

In order to secure driving margin of the PDP which enable such high-speed driving, the sustain period length t2 of the reset signal where the voltage Ve is sustained may be changed according to the APL of the display screen within a range of 1 μs to 50 μs.

Further, when considering capacitance of the PDP and the amount of the voltage Ve, in order for the reset signal to rise up to the voltage Ve although the APL of the display screen has a predetermined value ranging from 0% to 100%, the sustain period length t2 of the reset signal where the voltage Ve is sustained may be in the range of 1 μs to 20 μs.

When the reset period length of the subfield is 200 μs or less, driving margin of the PDP for the address period and the sustain period can be secured sufficiently. Thus, when considering the rising period length t1 and the sustain period length t2 having the above ranges, the falling period length t3 of the reset signal where the voltage Ve drops may be in the range of 10 μs to 150 μs.

Figure 8:
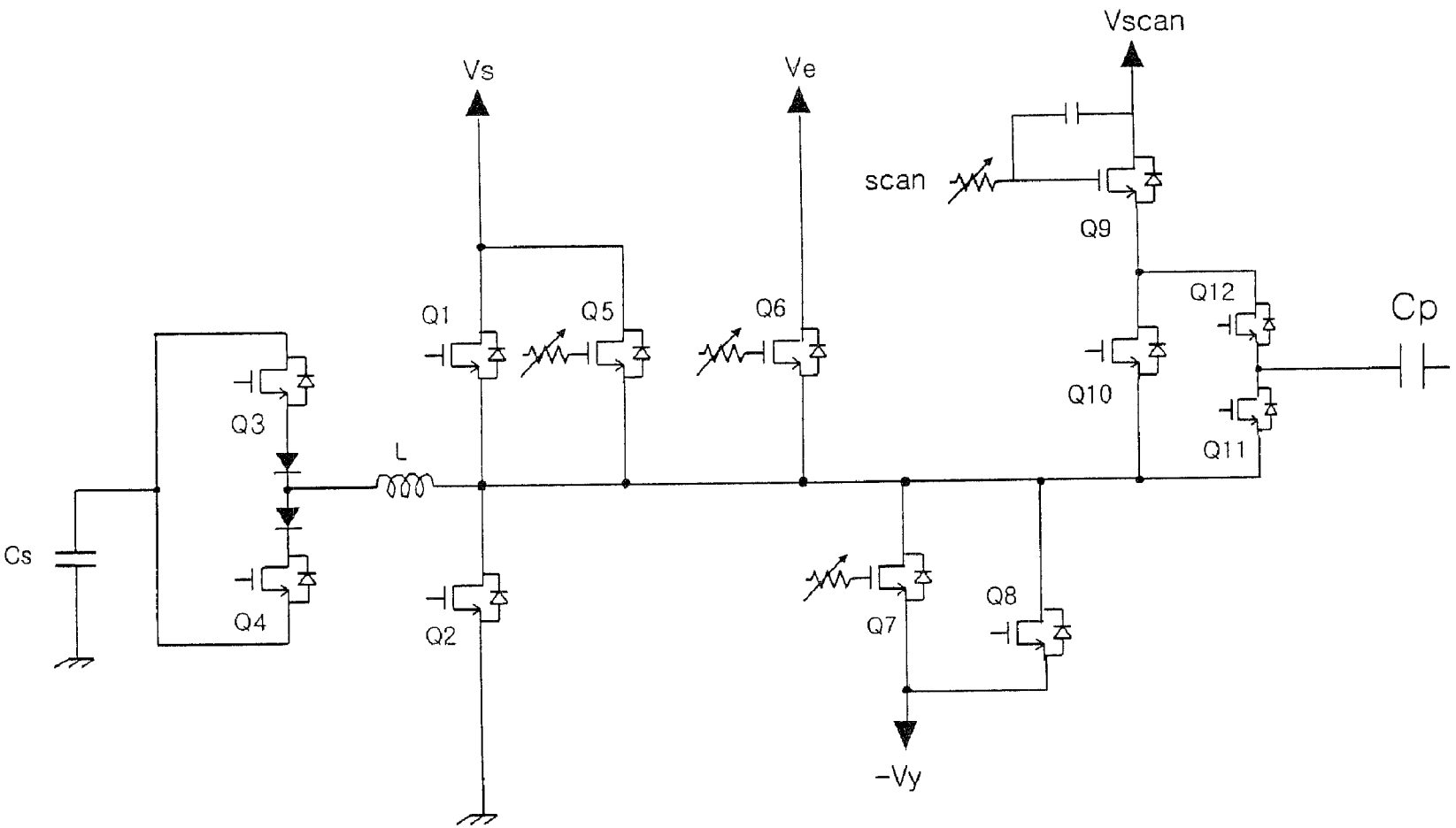
FIG. 8 is a circuit diagram illustrating an embodiment of a configuration of a scan driving circuit for supplying a driving signal to a scan electrode.

FIG. 8 is a circuit diagram illustrating an embodiment of a configuration of a scan driving circuit for supplying the driving signal to the scan electrode.

Referring to FIG. 8, the scan driving circuit in accordance with the present invention may include an energy recovery unit, a sustain driver, a reset driver, and a scan IC.

The sustain driver includes a sustain voltage source Vs that supplies a high potential sustain voltage Vs during the sustain period, a SUS-Up switch Q1 that is turned on to supply the scan electrode Y of the PDP with the sustain voltage Vs, and a SUS-Down switch Q2 that is turned on to drop a voltage, supplied to the scan electrode Y, to a ground voltage.

The energy recovery unit includes a source capacitor Cs for recovering and supplying energy supplied to the scan electrode Y, an energy supply switch Q3, which is turned on to supply the scan electrode Y with energy stored in the source capacitor Cs, and an energy recovery switch Q4 that is turned on to recover energy from the scan electrode Y to the source capacitor Cs.

The reset driver includes a set-up switch Q5 that is turned on to supply the scan electrode with a set-up signal that gradually rises, and a set-down switch Q7, which is connected to a negative polarity voltage source −Vy and turned on to supply the scan electrode with a set-down signal that gradually drops to a negative polarity voltage −Vy.

The set-up switch Q5 has a drain connected to the sustain voltage source Vs, a source connected to the scan IC, and a gate connected to a variable resistor (not shown). As a resistance value of the variable resistor is changed, the set-up switch Q5 generates the set-up signal that gradually rises.

The set-down switch Q7 has a drain connected to the scan IC, a source connected to the negative polarity voltage source −Vy, and a gate connected to the variable resistor. As a resistance value of the variable resistor is changed, the set-down switch Q7 generates the set-down signal that gradually drops.

As mentioned earlier with reference to FIGS. 5 to 7, in order to supply the scan electrode Y with the reset signal whose voltage rises up to the voltage Ve, which is lower than Vst, but higher than the sustain voltage Vs in at least one of the plurality of subfields, for example, subfields subsequent to the first subfield, the scan driving circuit according to an embodiment of the present invention may include an additional voltage source Ve.

In other words, in at least one of the plurality of subfields, for example, subfields subsequent to the first field, during the rising period of the reset signal, the set-up switch Q6 connected to the voltage source Ve is turned on and, therefore, a resistance value of the variable resistor connected to the gate of the set-up switch Q6 is changed. Accordingly, the voltage of the reset signal may gradually rise up to Ve.

The scan IC includes a scan-up switch Q12, which is connected to a scan voltage source Vscan and is turned on to apply the scan electrode with the scan voltage Vsc, and a scan-down switch Q11 that is turned on to apply the scan electrode with the ground voltage.

An embodiment of the driving apparatus of the PDP according to the present invention has been described with reference to FIG. 8 by taking the additional voltage source Ve for supplying the reset signal whose voltage rises up to Ve as an example. It is, however, to be noted that the present invention is not limited to the above example, but a variety of driving circuits capable of raising the reset signal up to a voltage between the sustain voltage Vs and the voltage Vst may be configured.

In accordance with the present invention constructed above, if it is sought to reset the discharge cells of the PDP in the reset period, a signal whose voltage gradually rises up to a voltage higher than the sustain voltage is applied to the scan electrode. Accordingly, wall charges of the scan electrode for addressing can be controlled effectively, the highest voltage of the reset signal can be lowered and therefore driving margin can be secured. Further, since the sustain period of the highest voltage is included, stabilized discharge can be generated irrespective of variation of an APL of a display screen.

While the invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A plasma display apparatus, comprising:

a plasma display panel having a plurality of scan electrodes and sustain electrodes formed on a front substrate and a plurality of address electrodes formed on a rear substrate; and a driver that supplies driving signals to the plurality of electrodes, wherein the plasma display panel is driven with a unit frame which is divided into a plurality of subfields;

wherein a reset signal supplied during a reset period of a first subfield of the plurality of subfields comprises a first rising period during which a voltage rises up to a first voltage, and a first sustain period during which the first voltage is sustained;

wherein a reset signal supplied during a reset period of a second subfield of the plurality of subfields comprises a second rising period during which a voltage rises up to a second voltage lower than the first voltage, and a second sustain period during which the second voltage is sustained;

wherein the second voltage is higher than a sustain voltage; and wherein a slope of the second rising period is in inverse proportion to an average picture level of a display screen and a length of the second sustain period is in inverse proportion to the average picture level of the display screen.

2. The plasma display apparatus of claim 1, wherein the first rising period has a length longer than a length of the second rising period.

3. The plasma display apparatus of claim 1, wherein the second rising period has a length of 1 μs to 100 μs.

4. The plasma display apparatus of claim 1, wherein the second sustain period has a length of 1 μs to 50 μs.

5. The plasma display apparatus of claim 1, wherein the second sustain period has a length of 1 μs to 20 μs.

6. The plasma display apparatus of claim 1, wherein the reset signals supplied during the reset periods of the first and second subfields comprise first and second falling periods where voltages gradually fall, respectively, and wherein the first falling period has a length longer than a length of the second falling period.

7. The plasma display apparatus of claim 6, wherein the second falling period has a length of 10 μs to 150 μs.

8. The plasma display apparatus of claim 1, wherein the first rising period has a slope smaller than a slope of the second rising period.

9. The plasma display apparatus of claim 1, wherein the second rising period has a length, which is proportional to the average picture level of the display screen.

10. The plasma display apparatus of claim 1, wherein a peak voltage of the reset signal supplied during the reset period of the second subfield is equal to the second voltage.

11. The plasma display apparatus of claim 1, wherein the driver comprises a voltage source that supplies the second voltage.

12. The plasma display apparatus of claim 1, wherein in a previous subfield of the second subfield, a last sustain signal of a plurality of sustain signals supplied during a sustain period is supplied to the sustain electrode.

13. The plasma display apparatus of claim 1, wherein the first subfield is a first subfield of the plurality of subfields, and the second subfield is at least one of the remaining subfields.

14. A driving apparatus of a Plasma Display Panel for supplying a driving signal to the Plasma Display Panel, the Plasma Display Panel having a plurality of scan electrodes and sustain electrodes formed on a front substrate and a plurality of address electrodes formed on a rear substrate, wherein the Plasma Display Panel is driven with a unit frame that is divided into a plurality of subfields;

wherein a reset signal supplied during a reset period of a first subfield of the plurality of subfields comprises a first rising period during which a voltage rises up to a first voltage, and a first sustain period during which the first voltage is sustained;

wherein a reset signal supplied during a reset period of a second subfield of the plurality of subfields comprises a second rising period during which a voltage rises up to a second voltage lower than the first voltage, and a second sustain period during which the second voltage is sustained;

wherein the second voltage is higher than a sustain voltage; and a slope of the second rising period is in inverse proportion to an average picture level of a display screen and a length of the second sustain period is in inverse proportion to the average picture level of the display screen.

15. The driving apparatus of claim 14, wherein the first rising period has a length longer than a length of the second rising period.

16. The driving apparatus of claim 14, wherein the second sustain period has a length of 1 μs to 20 μs.

17. The driving apparatus of claim 14, wherein a peak voltage of the reset signal supplied during the reset period of the second subfield is equal to the second voltage.

* * * * *